US005411330A

United States Patent [19]

Arutyunov et al.

[11] Patent Number: 5,411,330

[45] Date of Patent: May 2, 1995

[54] MOEBIUS SHAPED MIXING ACCESSORY

[75] Inventors: Yury A. (born Rjabokoni') Arutyunov; Lyudmila A. (born Ryabokoni) Gorislavskaya, both of Zhukovsky, Russian Federation

[73] Assignee: Novecon Technologies, L.P., Washington, D.C.

[21] Appl. No.: 43,763

[22] Filed: Apr. 6, 1993

[30] Foreign Application Priority Data

Apr. 29, 1992 [RU] Russian Federation ..... 5040219

[51] Int. Cl.[6] ..... B01F 5/12; B01F 7/16

[52] U.S. Cl. ..... 366/270; 366/301; 366/343; 416/227 R

[58] Field of Search ..... 416/227 R, 227 A, 231 A; 366/66, 97, 262–265, 129, 270, 297, 299–301, 325, 329, 342, 343, 605

[56] References Cited

U.S. PATENT DOCUMENTS

| | | | |
|---|---|---|---|
| 375,384 | 12/1887 | Quack | 366/300 |
| 917,217 | 4/1909 | Weston | 416/227 A X |
| 1,506,951 | 9/1924 | Soukup | 366/129 X |
| 1,733,516 | 10/1929 | Rodin et al. . | |
| 2,525,338 | 10/1950 | Brown et al. | 366/129 X |
| 2,559,418 | 7/1951 | Ford . | |
| 2,628,082 | 2/1953 | Fredenhagen et al. | 366/300 |
| 3,306,588 | 2/1967 | Reid | 416/227 X |
| 3,314,660 | 4/1967 | Arbiter . | |
| 3,717,330 | 2/1973 | Pinney . | |
| 4,615,623 | 10/1986 | Wethern | 366/279 |
| 4,776,703 | 10/1988 | Oda et al. . | |
| 4,871,259 | 10/1989 | Harada et al. . | |
| 5,094,543 | 3/1992 | Mursa . | |

FOREIGN PATENT DOCUMENTS

| | | | |
|---|---|---|---|
| 47222 | 4/1911 | Austria | 416/227 R |
| 4424034 | 10/1969 | Japan | 416/227 R |
| 868103 | 9/1981 | U.S.S.R. | 416/227 A |
| 903130 | 2/1982 | U.S.S.R. . | |

*Primary Examiner*—David A. Scherbel
*Assistant Examiner*—Charles Cooley
*Attorney, Agent, or Firm*—Dickstein, Shapiro & Morin

[57] ABSTRACT

An accessory for a mixer having a first Moebius shaped mixing blade mounted to a shaft and having a second, mirror image, Moebius shaped mixing blade mounted to a second shaft, the second shaft being oriented parallel to the first shaft, and wherein the individual mixing blades, as viewed from the plane normal to each shaft axis, form the FIG. 8.

1 Claim, 3 Drawing Sheets

MOEBIUS SHAPED MIXING ACCESSORY

BACKGROUND OF THE INVENTION

The present invention relates to an improved mixing accessory. More particularly, the present invention relates to a mixing accessory having two Moebius shaped mixing blades arranged to promote high mixing efficiency of the ingredients to be mixed and thereby producing a more uniform mixture.

Attempts have been made to provide mixing accessories which generate a more uniform mixture of the ingredients to be mixed. These attempts are described as follows.

U.S. Pat. No. 4,615,623, discloses a mixing accessory having blades mounted by their end faces at two spots on a central shaft. The blades are an arc-like design, their ends being twisted at an angle of 90 degrees. The developed view of the two blades as a whole is an S-like figure with a straight portion near the area of the shaft at which the blades are attached and rounded areas at the ends of the figure. The mid-line of the S-like figure is straight at the shaft axis. At this area the blades are mounted on the shaft along the normal to its axis. But the angle of the mid-line of one blade is 180 degrees, i.e. the limiting points of the figure are connected by a straight line passing through the shaft axis. The modified blade has separated parts mounted on a tubular shaft.

USSR inventor's certificate #903130, BOIF 7/24, 1982 discloses a mixing accessory that includes a vertical shaft with a primary mixing blade in the shape of a one-sided surface like a Moebius strip and at least one auxiliary blade shaped to form a helix. The auxiliary blade is mounted on the shaft at some angle with respect to the main one. The two strips are fixed on the shaft at the diametrical generatrices.

The prior art devices have many limitations. In particular, the mixing accessory of the U.S. Pat. No. 4,615,623 patent cannot reach high mixing efficiency. At high rotation speeds of 5000 to 8000 RPM (typical of the state-of-the-art mixers) the effect of mixing along the shaft axis vanishes because the axial velocity is very low in comparison with the tangential one. Ingredients will only be rotated, not mixed, since they move in parallel to each other.

The mixing accessory of the 903130 inventors certificate is not capable of providing high efficiency of mixing and requires much energy and time for treatment.

SUMMARY OF THE INVENTION

The disadvantages of the prior art are alleviated to a great extent by the present invention which provides an accessory for mixers that is composed of a vertical shaft and a Moebius shaped blade whose developed view (on the plane normal to the shaft axis) is the figure eight, its center being fixed at the shaft. This first blade is paired with an additional vertical shaft with an additional Moebius-type blade whose developed view is also in the shape of figure eight. The second Moebius-type blade is a mirror image of the first Moebius-type blade, the longitudinal axes of the developed views being normal to one another.

The improved mixing efficiency of the present invention is achieved by setting two parallel shafts carrying blades in the shape of closed one-sided Moebius surfaces. The developed view of one of the blades (on a plane perpendicular to the shaft axis) is a figure eight, with its center being attached to the shaft. The developed view of the other blade is, as well, a eight-like figure reflected in mirror with respect to the first one, the longitudinal axes of the develop views being normal to one another.

DETAILED DESCRIPTION OF PREFERRED EMBODIMENTS

Figure 1:
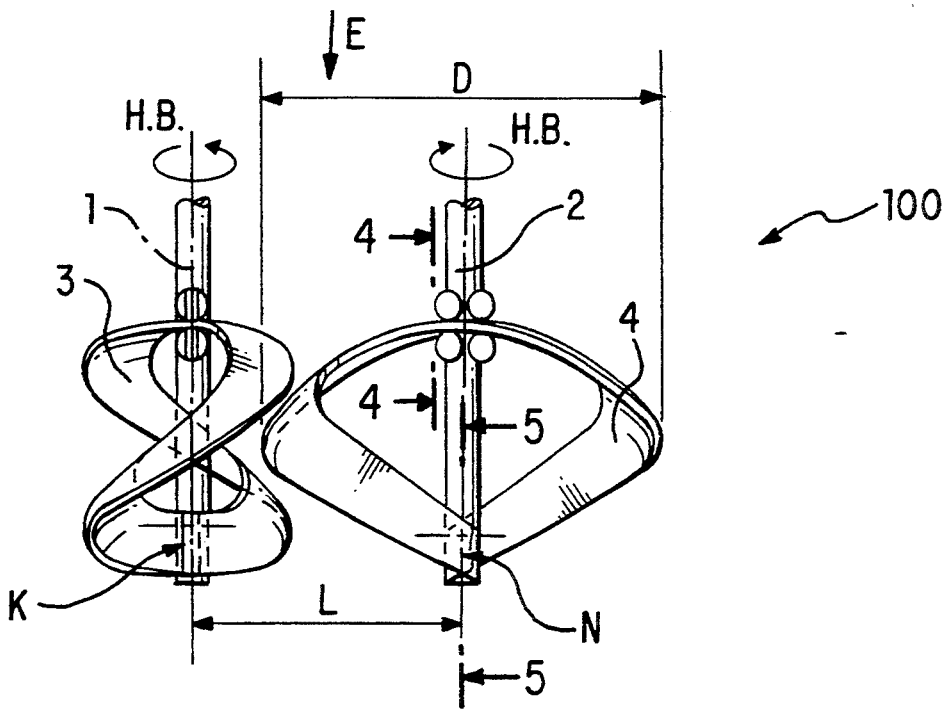
FIG. 1 is an illustration of the mixing accessory according to one embodiment of the present invention.

Refer now to FIG. 1, there being shown a mixing accessory, generally designated by reference numeral 100. The mixing accessory 100 is composed of two parallel shafts 1 and 2. The distance between the shafts L is 1.1D to 1.2D where D is the maximum size of a blade projected on the plane normal to the shaft axis.

Figure 2:
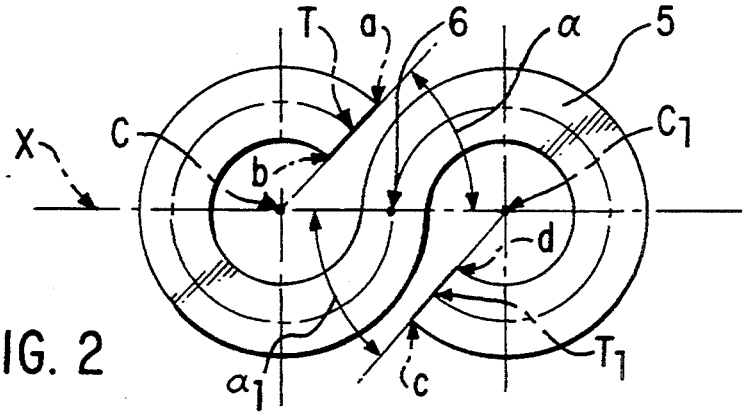
FIGS. 2 and 3 show the developed views of the Moebius-type blades of the mixing accessory of FIG. 1.

The shafts 1 and 2 carry blades 3, 4 in the shape of Moebius strips. The developed view of the blade 3 on a plane perpendicular to the shaft axis (FIG. 2) is the a figure eight-like element 5. The blade 5 will be fixed at its ends T, $T_1$ at the lower end K of the shaft so that the point "a" is connected with the point "c", the point "b" is connected with "d". The blade 5 will be fixed on the shaft 1 at its center 6.

Figure 3:
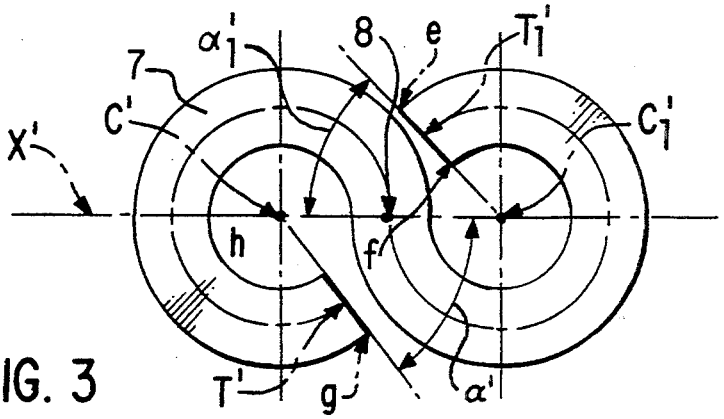

The developed view of the blade 4 on a plane perpendicular to the shaft axis (FIG. 3) is also figure eight-like 7 but is a mirror image of the other blade 5. The blade 7 will be fixed at its ends T', T1' at the bottom end N of the shaft 2 so that the point "e" is attached to the point "g", and the point "f" to the point "h". The element 7 has its center 8 fixed on the shaft 2.

The ends T, $T_1$, T' and $T_1'$ are cut so as to make angles $\alpha$, $\alpha_1$, $\alpha'$, and $\alpha_1'$ at the longitudinal axes x and x', respectively.

The angles above are identical, 45 to 60 degrees. The vertices of the angles are at centers C, $C_1$ C', and $C_1'$.

Figure 4:
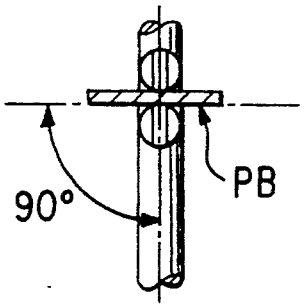
FIG. 4 is a view taken along line 4—4 of FIG. 1.

At the upper points of fixing the blades 3 and 4 on the shafts 1 and 2 (FIG. 4) the blade mid-surfaces PB are normal to the axes of the shafts 1 and 2.

Figure 5:
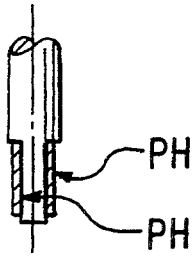
FIG. 5 is a view taken along line 5—5 of FIG. 1.

At the lower points of fixing the blades 3 and 4 on the shafts 1 and 2 (FIG. 5) the blade mid-surfaces PH are parallel to the axes of the shafts 1 and 2.

When mounted on the shaft, each blade forms a helical surface.

Figure 6:
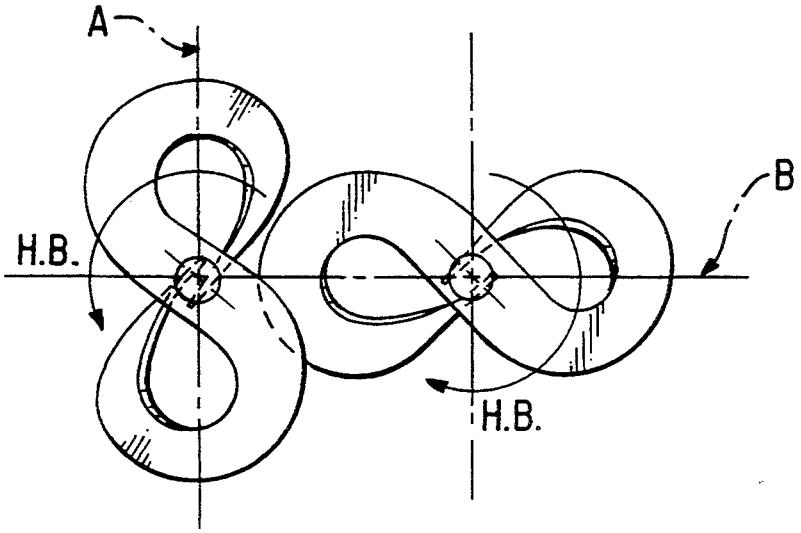
FIG. 6 depicts the view E of the mixing accessory of FIG. 1.

The longitudinal axes A and B (FIG. 6) of the blades 3 and 4, respectively, are normal to each other.

The tool operates as follows.

Figure 7:
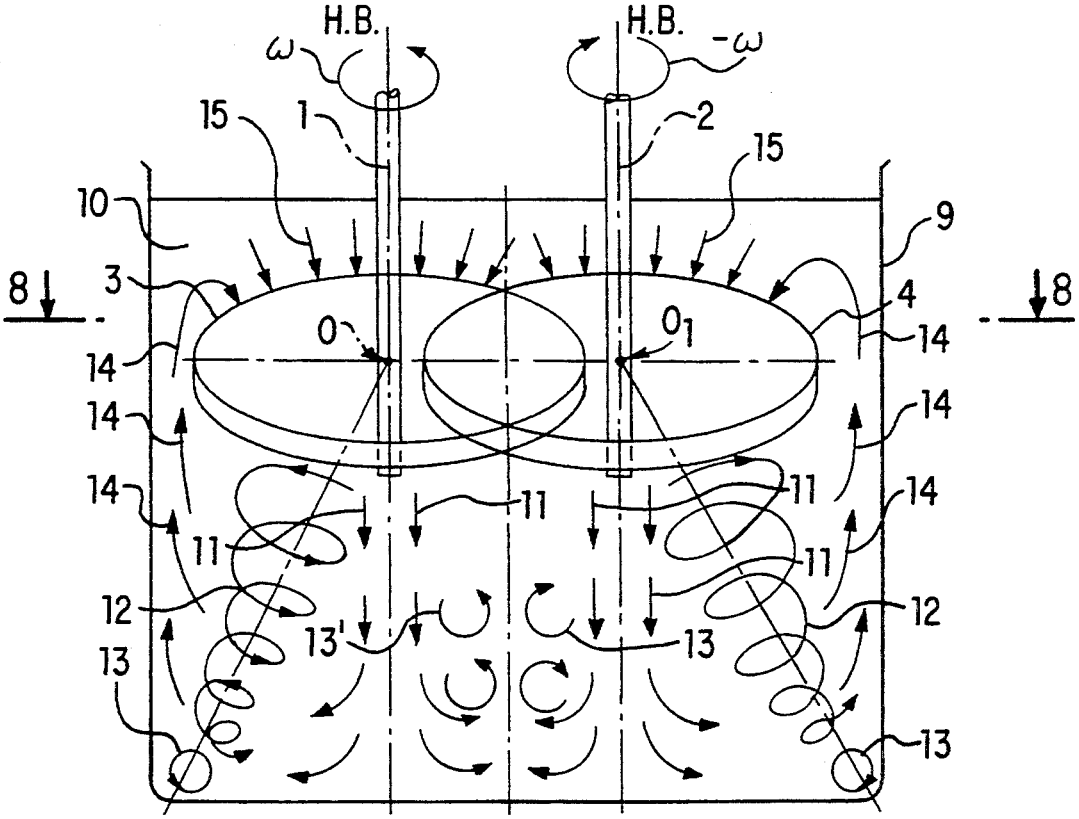
FIG. 7 depicts the vortices and flows generated by the operation of the mixing accessory of FIG. 1.
Figure 8:
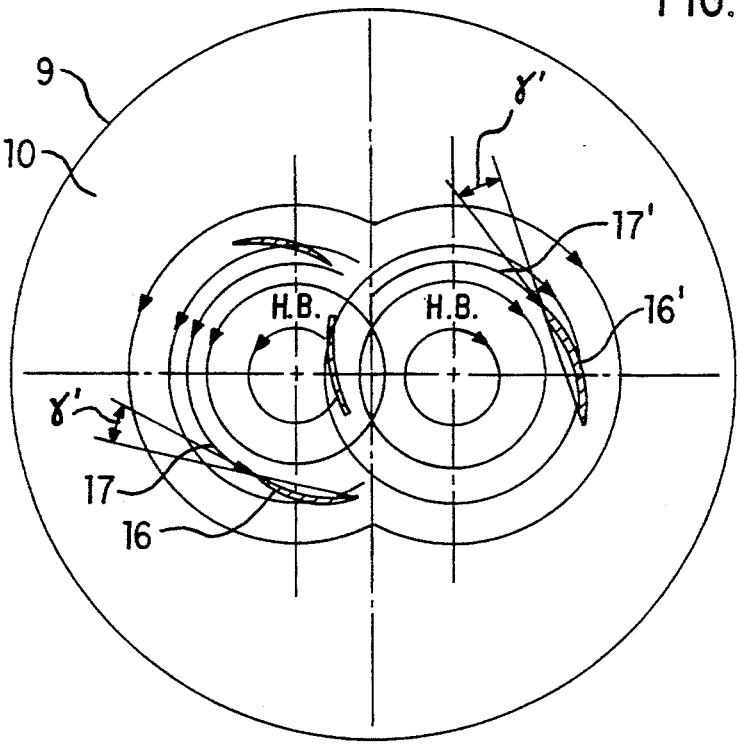
FIG. 8 is a view taken along line 8—8 of FIG. 7.

The accessory is in the tank 9 containing the ingredients 10 to be mixed (FIGS. 7 and 8).

The shafts 1 and 2 are positioned so the blades 3 and 4 are intermeshed and are counter-rotated (at angular speeds $\omega$ and $-\omega$), as shown by symbols HB.

Ingredients of the upper part of the tank 9 are moved downwards by the blades 3 and 4 and go in sequence through the capturing part and the rejecting part of the tool. After leaving the rejecting part the ingredients form an axial flow 11 and vortical systems 12 and 13. These vortex lines 12 and ring vortices 13 collide and partly destruct, then form the flow 14 and move upwards where the flow 15 appears; thereafter the process repeats. The ingredients are mainly captured in the upper hemisphere of the tool.

When rotated, each blade generates a severely twisted vortex directed from the surface of the liquid to the bottom of the tank. Such vortices from the two blades, 3 and 4, collide and generate new vortical structures which are of form of small-size ropes 12 from edges of the blades, and form two cones whose apexes are o and $o_1$ and the footings are on the bottom of the tank 9. The vortical flows are in mutually normal planes, create a finely dispersed system in the liquid, penetrate all of the volume, and significantly improve the mixing efficiency. Note that the cross sections 16 and 16[1] of the blades 3 and 4 (FIG. 8) are at low incidence (angles $\gamma$ and $\gamma'$) to the inflow 17 and 17[1], so the drag force is very low, whereas the force applied to the fluid is great because the interaction surface area is large—this results in reduced energy requirements.

The present accessories have been tested for various tools: (1) one shaft with a Moebius blade and (2) two shafts with Moebius blades (the present design). The experiments showed that the concept proposed may be very efficient in whipping the egg whites for mayonnaise and dough, while ensuring high-quality treatment and low energy consumption.

The above description and drawings are only illustrative of preferred embodiments which achieve the objects, features and advantages of the present invention, and it is not intended that the present invention be limited thereto. Any modifications of the present invention which comes within the spirit and scope of the following claims is considered part of the present invention. The disclosure of the attached Russian priority application is incorporated herein by reference.

We claim:

1. An accessory for mixers of the type for driving two parallel shafts, each carrying a mixing blade, in a container of ingredients to be mixed comprising:

a first shaft having a first-shaft longitudinal axis;

a first Moebius-type mixing blade mounted to said first shaft at a first-shaft first location and at a first-shaft second location; said first blade at said first-shaft first location being positioned at an angle with respect to said first blade at said first-shaft second location such that the projection of said first blade onto a plane normal to said first-shaft axis forms a figure eight-type shape; and said first mixing blade being twisted between said first-shaft first and first-shaft second locations such that said first mixing blade at said first-shaft first location is oriented normal to said first-shaft axis and said mixing blade at said first-shaft second location is oriented parallel to said first-shaft axis;

a second shaft having a second-shaft longitudinal axis;

a second Moebius-type mixing blade mounted to said second shaft at a second-shaft first location and at a second-shaft second location; said second blade at said second-shaft first location being positioned at an angle with respect to said second blade at said second-shaft second location such that the projection of said second blade onto a plane normal to said second-shaft axis forms a figure eight-type shape; and said second mixing blade being twisted between said second-shaft first and second-shaft second locations such that said second mixing blade at said second-shaft first location is oriented normal to said second-shaft axis and said mixing blade at said second-shaft second location is oriented parallel to said second-shaft axis;

said second mixing blade being a mirror image of said first mixing blade;

wherein said mixing blades are mounted with said first-shaft axis parallel to said second shaft axis such that said first mixing blade intermeshes with said second mixing blade during rotation of the mixing blades and such that rotation of said mixing blades in the ingredients causes vortices in the ingredients that collide with one another and cause said ingredients to flow in the container in a direction generally parallel to said axes to circulate through the container and back through said mixing blades.

* * * * *

UNITED STATES PATENT AND TRADEMARK OFFICE

CERTIFICATE OF CORRECTION

PATENT NO. : 5,411,330

DATED : May 2, 1995

INVENTOR(S) : Yury A. Arutyunov and Lyudmila A. (born Ryabokoni) Gorislavskaya

It is certified that error appears in the above-indentified patent and that said Letters Patent is hereby corrected as shown below:

On the title page: Item

[75] Inventors

"Yury A. (born Rjabokoni') Arutyunov" should read

-- Yury A. Arutyunov--.

Signed and Sealed this

Twentieth Day of August, 1996

Bruce Lehman

*Attest:*

BRUCE LEHMAN

*Attesting Officer*

*Commissioner of Patents and Trademarks*